United States Patent [19]

Palac

[11] 4,164,682

[45] Aug. 14, 1979

[54] SHADOW MASK SUSPENSION SYSTEM HAVING BRACKET MEANS INTEGRALLY FORMED FROM THE SHADOW MASK ASSEMBLY

[75] Inventor: Kazimir Palac, Carpentersville, Ill.

[73] Assignee: Zenith Radio Corporation, Glenview, Ill.

[21] Appl. No.: 837,496

[22] Filed: Sep. 28, 1977

Related U.S. Application Data

[62] Division of Ser. No. 646,803, Jan. 5, 1976, abandoned.

[51] Int. Cl.[2] ..... H01J 29/08

[52] U.S. Cl. ..... 313/404; 313/407

[58] Field of Search ..... 313/405, 404, 406, 407, 313/408

[56] References Cited

U.S. PATENT DOCUMENTS

| | | | |
|---|---|---|---|
| 3,803,436 | 4/1974 | Morrell | 313/405 |
| 3,894,260 | 7/1975 | Sedivy | 313/405 |
| 3,898,508 | 8/1975 | Pappadis | 313/405 |
| 3,943,399 | 3/1976 | Sedivy | 313/405 |

*Primary Examiner*—Robert Segal
*Assistant Examiner*—Darwin R. Hostetter
*Attorney, Agent, or Firm*—Ralph E. Clarke, Jr.

[57] ABSTRACT

This application depicts a rectangular-type color cathode ray tube having a rearwardly flanged faceplate for suspending an approximately rectangular shadow mask assembly on the faceplate flange at a predetermined spacing from a screen-bearing surface of the faceplate. The mask assembly comprises a rigid frame to which is attached a shadow mask member; also, there are a plurality of mask suspension devices spaced around the assembly. At least one of the devices comprises a metal stud embedded in and extending inwardly from the faceplate flange, and mask-mounted means for retentively engaging said stud. The mask-mounted means comprises a sheet metal bracket integrally formed from the mask assembly so as to extend radially outwardly from the assembly; it also comprises a discrete metal leaf spring affixed at one end to the distal end of the bracket means and having provision on its distal end for retentively engaging the stud. The mask mounted means is characterized by having welded on the integrally formed bracket means at least one strip composed of a material having a coefficient of thermal expansion which is significantly different from that of the bracket means. The aforesaid strip is arranged on the bracket means and sized such that upon heating of the mask assembly, the bracket means bends out of its plane to effect a compensating adjustment in the spatial position of the mask assembly relative to the screen-bearing surface of the faceplate.

2 Claims, 12 Drawing Figures

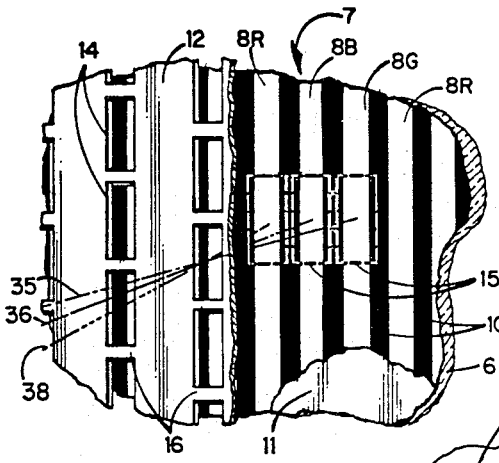
Fig. 2.
Fig. 5
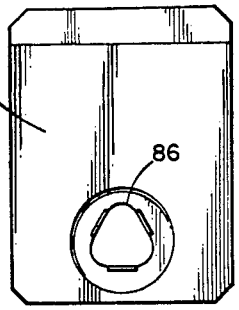
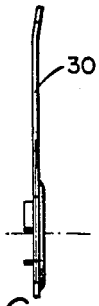
Fig. 6
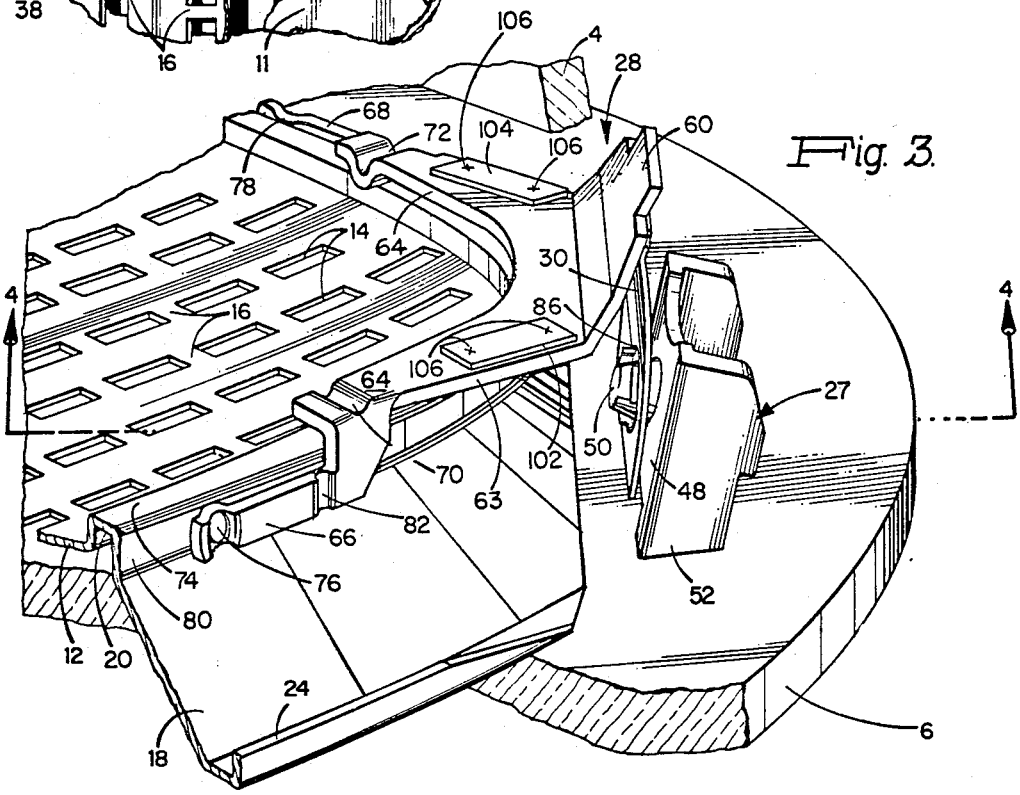
Fig. 3.
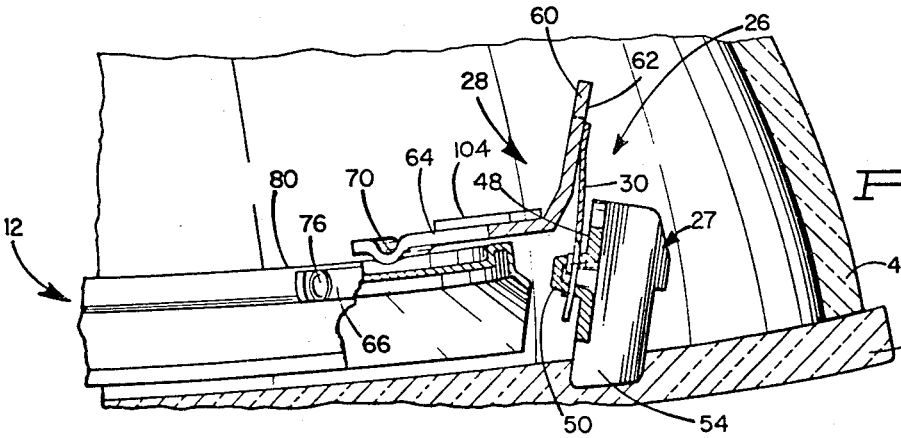
Fig. 4.

Fig.8
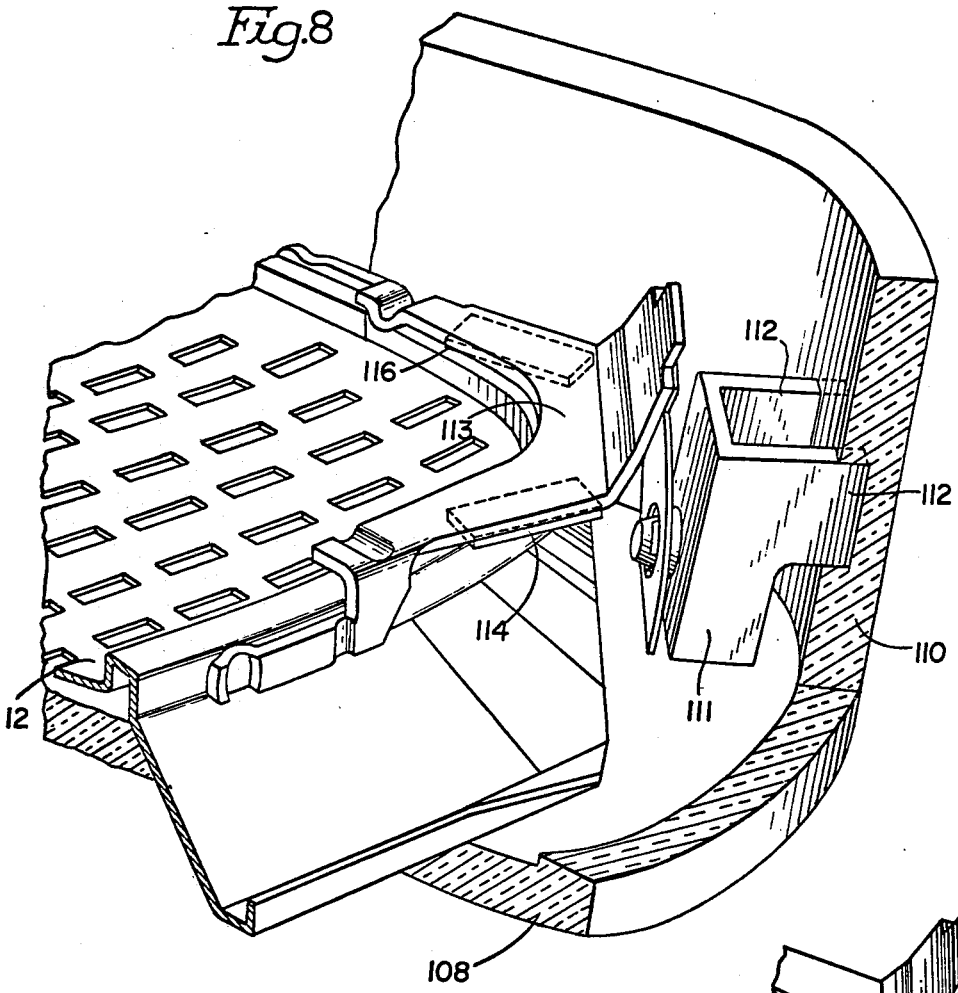
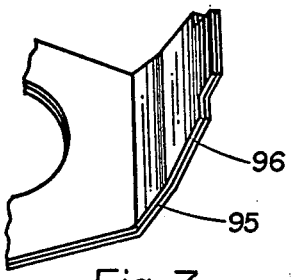
Fig. 7
PRIOR ART
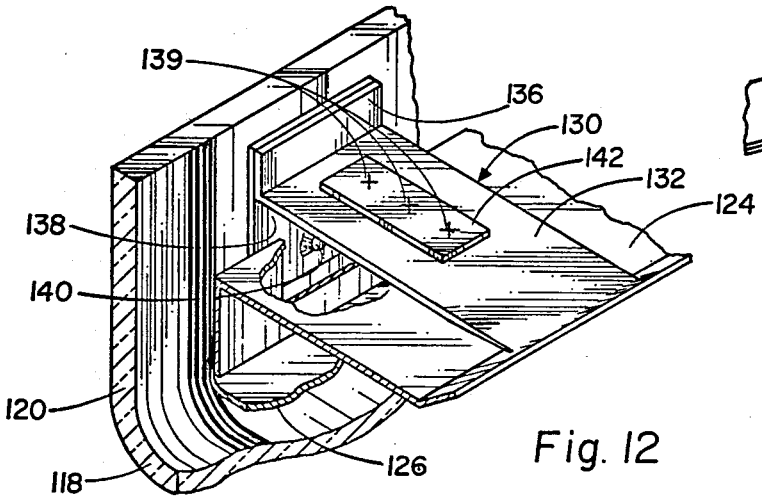
Fig. 12

SHADOW MASK SUSPENSION SYSTEM HAVING BRACKET MEANS INTEGRALLY FORMED FROM THE SHADOW MASK ASSEMBLY

CROSS-REFERENCE TO RELATED APPLICATIONS

This application is a division of application Ser. No. 646,803 filed Jan. 5, 1976, now abandoned, and is related to, but in no way dependent upon, copending applications including U.S. Pat. No. 3,943,399 issued Mar. 9, 1976 (a continuation-in-part of now-abandoned application Ser. No. 395,106, filed Sept. 7, 1973); Ser. No. 498,836, filed Aug. 19, 1974 (a continuation of Ser. No. 285,985, filed Sept. 5, 1972 but now abandoned); U.S. Pat. No. 4,028,480 issued June 7, 1977; U.S. Pat. No. 3,986,072 issued Oct. 12, 1976; and U.S. Pat. No. 3,999,093, issued Dec. 21, 1976, and U.S. Pat. Nos. 3,912,963; 3,896,321, all assigned to the assignee of the present invention.

BACKGROUND OF THE INVENTION

This invention relates to color cathode ray tubes of the type having a shadow mask, and especially to a system for suspending a shadow mask adjacent to a faceplate portion of the tube. This invention has applicability to suspension systems for shadow masks of various types and to the suspension of shadow masks on tube envelopes of various constructions.

In its preferred execution, the invention of the parent application represents an improvement on the mask suspension system described and claimed in certain of the referent copending applications, particularly U.S. Pat. No. 3,999,098, issued Dec. 21, 1976. In accordance with the invention described and claimed in that application, a plurality of mask suspension devices are provided, each of which comprises a novel sheet metal bracket. The bracket has a pair of arms which are welded on adjoining sides of a mask corner. It is not certain whether such a mask and mask suspension system require thermal "Q" compensation, that is, provision for adjusting the "Q" distance between the mask and faceplate to compensate for thermally induced mask expansion and contraction. However, if such is deemed to be necessary, the aforesaid referent copending application teaches that such can be provided by forming the bracket from a laminate type (side-bonded) bi-metallic material.

It has been found, however, that to provide thermal compensation by the use of a laminate-type bimetallic bracket has a number of shortcomings. First, the cost of laminate bimetallic material is very high, a factor which strongly militates against the use of such a material. Second, it has been found to be quite difficult to weld such a bracket made from a laminate bimetallic material to a shadow mask as described. There are two reasons for this. First, the bracket is of relatively thick material (for example, about 60 mils) compared to the shadow mask (typically about 6 mils). Without more, it will be recognized that some difficulty will be had in attempting to weld a relatively thick bracket to a relatively thin shadow mask.

Secondly, assuming the bimetallic laminate material to be, for example, invar on the side away from the faceplate and stainless steel on the side closest to the faceplate, because the stainless steel has a higher coefficient of expansion than invar (as it must if the mask is to move toward the faceplate when heated), then the stainless steel is on the side of the bracket which must be welded to the shadow mask. But stainless steel has a higher electrical resistance than cold-rolled steel, the material from which a shadow mask is typically made. This means that in order to achieve an adequate weld, an amount of electrical power must be applied during the welding operation which is apt to injure the shadow mask. Specifically, weld currents high enough to achieve satisfactory welding effects on the stainless steel are apt to burn the relatively thin, cold-rolled steel shadow mask.

The result of these welding difficulties is a reduced yield in the attachment of the brackets to the shadow mask. The resulting reduced yield is, of course, translatable into a higher per unit cost of the shadow mask and its suspension system.

The mask suspension systems of the referent copending applications have achieved noteworthy success in developmental tests. This invention, however, represents an improvement over the systems of the said applications in applications where it is desired to provide economies in the manufacture of mounting means for shadow mask assembles.

| Other Prior Art | | |
|---|---|---|
| U.S. | | British |
| 2,823,328 | Vincent | 1,278,633 |
| 2,922,063 | Haas | 1,278,632 |
| 2,961,560 | Fyler | 1,278,635 |
| 3,497,746 | Duistermaat et al | 1,772,334 |
| 3,529,199 | Duistermaat et al | Japanese |
| 3,537,159 | Gartner | 45-32495 |
| 3,548,235 | Duiedijk et al | German |
| 3,573,527 | Hofkenscheid et al | OLS 2454 415 |
| | | OLS 2454 416 |

OBJECTS OF THE INVENTION

It is a general object of this invention to provide a color cathode ray tube having an improved suspension system for suspending a shadow mask adjacent to the tube's faceplate portion.

It is another object of this invention to provide a shadow mask suspension system which provides thermal "Q" compensation at unusually low cost by obviating the need for expensive bimetallic materials and by providing suspension structures which make possible the obviation of the aforesaid difficulties in the welding of the mask and mask suspension system components.

It is a more specific object of this invention to provide economies in the manufacture of mounting means for shadow mask assemblies.

BRIEF DESCRIPTION OF THE DRAWINGS

The features of the invention which are believed to be novel and unobvious are set forth with particularity in the appended claims. The invention, together with further objects and advantages thereof, may be best understood by reference to the following description taken in connection with the accompanying drawings, in which:

FIGS. 2-4 are enlarged views of portions of the FIG. 1 tube;

FIGS. 5 and 6 are isolated front and side elevational views of a spring constituting part of the suspension devices shown in FIGS. 1, 3 and 4;

FIG. 7 is an isolated fragmentary view of a prior art bracket composed of a laminate bimetallic material;

FIG. 8 is a fragmentary perspective view of a device representing another embodiment of the invention of the parent application;

FIG. 12 shows a mask suspension device wherein the bracket supporting the shadow mask is formed integrally from the mask assembly according to this invention.

DESCRIPTION OF THE PREFERRED EMBODIMENT

Figure 1:
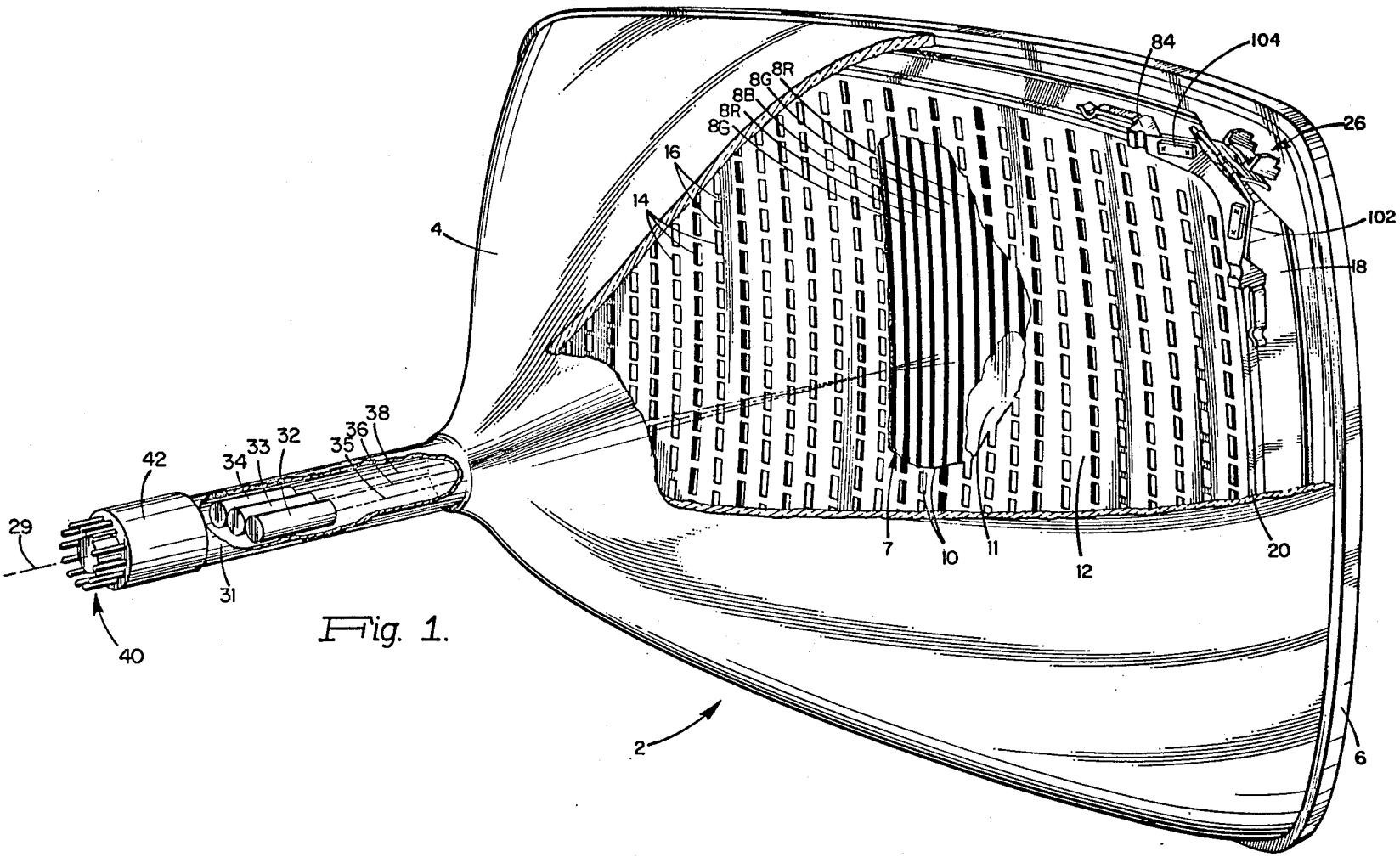
FIG. 1 is a perspective view of a unique color cathode ray tube, partly broken away to reveal an embodiment of a shadow mask suspension system implementing the principles of the invention of the parent application.

This invention is directed to providing an improved shadow mask suspension system which has many and diverse applications and which provides economies in manufacture. As used herein, the term "shadow mask assembly" is intended to mean, collectively, the mask, its supporting frame, if any, and all attached hardware. The term "shadow mask" is intended to encompass all masks, including post-deflection focus masks, in which there is produced a shadowing effect, whether total or only partial (as in a post deflection focus tube), and is sometimes used, for convenience, to mean the entire mask assembly.

The unique suspension system with which the invention of the parent application is most advantageously associated includes four suspension devices, one at each corner of the mask. The general concept, however, of a lightweight, non-self-rigid, torsionally flexible, rectangular shadow mask which is supported at its four corners so as to permit it to conform to the contour of a cathode ray tube faceplate was first described and claimed in the above-noted copending application of K. Palac, Ser. No. 675,653, filed Apr. 12, 1976 (a continuation-in-part of the original application, now abandoned).

FIGS. 1–4 illustrate a color cathode ray tube 2 incorporating a mask suspension system which implements the principles of the invention of the parent application. The tube 2 is depicted as having an envelope comprising a funnel 4 sealed to a rectangular flangeless faceplate 6. The tube 2 includes a lightweight, rectangular, non-self-rigid, torsionally flexible shadow mask 12 of novel character described in detail and claimed in the referent U.S. Pat. No. 3,912,963.

The illustrated tube 2 is shown as having on the inner surface of the faceplate 6 a phosphor screen 7 (see FIG. 2). The screen is illustrated as comprising an array of vertically oriented, horizontally repeating triads of red-emissive, blue-emissive and green-emissive phosphor elements 8R, 8B and 8G. The screen is preferably of the negative guardband, black matrix type as taught in U.S. Pat. No. 3,146,368. An aluminum layer is shown at 11. A black grille 10 comprises in this embodiment a pattern of light-absorptive bands separating the phosphor elements 8R, 8B and 8G.

The shadow mask 12 has a pattern of "slot" or "slit" apertures 14, spaced by "tie-bars" 16, which apertures define beam landings 15. The shadow mask 12 is non-self-rigid and may conveniently be of a frameless, one piece construction metal-formed from a single sheet of electrically conductive materials such as 6 mil thick, cold-rolled steel. An integral skirt 18 shields the screen 7 from stray and overscanned electrons. The skirt 18 and an integrally formed channel 20 and edge lip 24 enhance the stiffness of the mask with respect to its major and minor axes, while permitting the mask to flex with respect to its diagonals and thereby conform, when mounted, to the contour of the faceplate.

The tube is shown as including a neck 31, within which is contained an electron gun assembly. The electron gun assembly may take any of a variety of constructions, but in the illustrated embodiment wherein the mask is a slot mask cooperating with a screen of the "line"-type, the electron gun assembly preferably is of the "in-line"-type, comprising three separate guns 32, 33, 34 generating three coplanar beams 35, 36, and 38 which carry, respectively, red-associated, blue-associated and green-associated color video information. The electron gun assembly is electrically accessed through pins 40 in the base 42 of the tube.

A mask suspension system constructed according to the invention of the parent application will now be described. FIGS. 3 and 4 show in close-up detail a preferred mask suspension device 26 which may be employed on at least three of the four corners of the mask 12. The device for the fourth corner must hold the proper "Q" spacing (the spacing between the mask and the screen-bearing faceplate surface), while allowing the fourth corner of the mask to seek an equilibrium position in its own plane. The requirements on the fourth corner device are thus somewhat different than for the other three devices, permitting the fourth device to be of somewhat different construction.

The illustrated mask suspension device 26 includes envelope-associated means on the tube faceplate. Whereas numerous other envelope-associated means are contemplated the parent in the FIGS. 1–4 embodiment the envelope-associated means is shown as taking the form of a stud 27. The stud 27 does not per se, constitute an aspect of the invention of the parent application, being described and claimed in the reference copending applications Ser. Nos. 527,001 and 528,533.

The stud 27 is preferably a sheet-metal stamping and is illustrated as having a channel shape with a forwardly extending face 48 containing an integral protuberance or lug 50 and two legs 52, 54 which are embedded in (or which may, in another form, be cemented to) the faceplate 6.

The spaced legs 52, 54 permit screening fluids suffused across the faceplate during the faceplate screening operations to pass through the stud 27 without clogging it and without creating reflection-induced non-uniformities in the end-product screen.

In accordance with the FIGS. 1–4 embodiment of the invention of the parent application, the suspension device 26 also includes mask-mounted means for retentively and detachably engaging the envelope-associated means (here shown as the stud 27). The mask-mounted means may take various forms, but is here shown as including a novel bracket 28 constituting an aspect of an invention to be described in detail below and a cantilevered leaf spring 30 affixed to the bracket 28 and having provision for retentively engaging the stud 27.

The bracket 28 in its illustrated form extends around a corner of the mask on the outside and in the plane thereof. The bracket 28 is welded to the mask on adjoining sides of the mask corner.

The bracket 28 is composed of sheet metal, e.g., 60 mil thick cold-rolled steel, and is illustrated as including a head 60 having a radially outwardly directed face surface 62 preferably extending approximately parallel to the mask/tube axis 29 when the mask is operatively mounted within a tube. The bracket 28 includes a pair of diverging planar arms 63, 64 extending transversely to the mask/tube axis 29. The arms 63, 64 each have a provision, here shown as a pair of dimples 70, 72, structured to be welded to a mask surface, here shown as the back surface 74 of channel 20.

The arms 63, 64 have a pair of wings 66, 68 bent out of the plane of the arms 63, 64. The wings 66, 68 have areas on their distal ends, here shown as dimples 76, 78 intended to be welded to side surfaces of the mask, illustrated as side surfaces 80 of the channel 20. The wings 66, 68 have, at a point between the supporting arms 63, 64 and the proximate dimple, a provision having radial yield prior to attachment, here shown as thinned-down sections 82, 84. The thinned-down section in each of the wings 66, 68 provides a radial yield (out of the plane of the wing) before welding, yet provides high rigidity in the plane thereof, i.e., in the tube's axial direction.

The leaf spring 30 constitutes an important aspect of the invention described and claimed in the referent copending application U.S. Pat. No. 3,986,072 issued Oct. 12, 1976. The leaf spring 30 is shown in isolation in FIGS. 6 and 7. The spring 30 is shown as being welded at one end to the face surface 62 of the head 60 of bracket 28, and in the illustrated embodiment of the invention of the parent application extends toward the faceplate. A provision on the distal end of the spring, here shown as an aperture 86, retentively receives the mating lug 50 on the stud 27 when the mask 12 is operatively mounted in a tube. In the illustrated embodiment, the periphery of the aperture 86 has been stamped to assume a shape which will discourage frictional "hanging up" of the spring 30 on the lug 50.

It is important in a system of the character described that at least three of the four suspension devices be very stiff in a tangential direction and fix the spatial position of the mask in the plane thereof. The fourth suspension device must have provision for permitting the fourth corner of the mask to seek an equilibrium position in the plane of the mask, while cooperating with the other devices in precisely fixing the "Q" spacing of the mask. To this end, the fourth suspension device, that is the suspension device that is not like the other three and provides redundancy compensation, may be of somewhat different construction than the other three suspension devices. In particular, the fourth suspension device may be constructed similar to the FIGS. 1–4 device except that the mask engagement provision in the stud is an aperture rather than a lug, and the aperture in the stud is elongated in a direction parallel to the faceplate inner surface when the stud is mounted. The mask-mounted component of the fourth suspension may be generally similar to the mask-mounted components of the FIGS. 1–4 device 26, but may have a lug at its distal end, rather than an aperture. The lug, upon engagement with the elongated stud aperture, permits the fourth corner of the mask to seek an equilibrium position in its own plane (which position is determined by the other three suspension devices), and yet the proper "Q" spacing between the mask and the faceplate inner surface is maintained.

The described system wherein three of the suspension devices have the male members on the envelope-associated component and one male member on the mask-mounted component of the fourth device does not, per se, constitute an aspect of this invention.

The invention according to the parent application will now be described in detail. As explained above, the invention is directed to the provision of a shadow mask suspension system having low-cost provision for adjusting the spatial position of the shadow mask relative to the faceplate to compensate for thermal expansion and contraction of the shadow mask. As is well known in the art, when a shadow mask is bombarded by the electron beams which form the television image, the shadow mask will experience thermal expansion. The expansion of the shadow mask has the effect of enlarging the pattern of electron-transmissive apertures in the mask with the result that they are apt to no longer register perfectly with the pattern of phosphor triads. This is because the pattern of phosphor triads is deposited in a room temperature photoscreening process, using the mask aperture pattern as a photographic stencil. As is also well known in the art, any such misregistration between electron beam landing spot and phosphor element caused by expansion of the mask can be compensated, at least in part, by causing the mask to be displaced slightly toward the faceplate. This causes the mask aperture pattern and the phosphor triad pattern to again be brought into registry.

As suggested in the copending application Ser. No. 603,984, thermal "Q" compensation can be accomplished in the mask suspension system by causing the bracket 28 to be fabricated from a laminate-type bimetallic material. Such a bracket is shown in FIG. 7. The FIG. 7 prior art bracket is shown as being composed of a laminate material comprising two metal layers 95, 96 which are bonded together, face-to-face. In order to cause the bracket to deflect (bend) away from the faceplate (thereby producing a movement of the mask toward the faceplate), the metal layer having the highest coefficient of thermal expansion is the layer 95 on the side of the bracket nearest to the faceplate. The lower coefficient of expansion material is in the layer 96 on the opposite side of the bracket.

As noted above, a bracket such as shown in FIG. 7 might typically have metal layer 95 composed of stainless steel and a metal layer 96 composed of invar. However, again as noted above, there arise difficulties in welding such a bracket to the thin cold-rolled steel shadow mask. Further, laminate bimetallic materials such as would be needed to fabricate a bracket as shown in FIG. 7 are expensive and therefore are not desirable, particularly in the manufacture of a tube, a primary motivational force behind which is cost economization.

FIGS. 1–6 illustrate a shadow mask suspension device incorporating an improved thermally compensating article. In particular, FIGS. 1–6 show the article as taking the form of the described bracket 28 to which is affixed as a discrete component the afore-described spring 30. In accordance with this invention set forth in the parent application, the bracket 28 is caused to have thermal compensating capability by the provision of a pair of strips 102, 104 composed of a material having a significantly different coefficient of thermal expansion than the material from which the bracket 28 is composed.

Since, in the FIGS. 1–6 embodiment, the strips 102, 104 are affixed to the side of the bracket 28 away from the faceplate, the strips must be composed of a material having a lower coefficient of thermal expansion than the material of which the bracket is composed. By way of example, the bracket 28 may be composed of a material which is the same as that from which the shadow mask is made, typically cold-rolled steel, in order to facilitate welding of the bracket 28 to the shadow mask.

In the illustrated FIGS. 1–6 embodiment of the invention of the parent application, the strips 102, 104, whose coefficient of thermal expansion is lower than that of the bracket 28, may be composed of a material such as invar. The strips are affixed to the arms 63, 64, as by welding, at a number of weld points 106, two of which are shown on each strip.

The desired amount of thermal compensation demanded by a particular mask and mask suspension system can be achieved by selection of the appropriate length, width, thickness, shape and material for the strips 102, 104, by the number of weld points, by the location of the strips on the bracket 28, and by appropriate selection of material, configuration, and other physical parameters of the bracket 28, and by its orientation relative to the faceplate and to the mask axis.

The only cost associated with provision of a thermally compensating capability for the illustrated mask suspension system is that associated with the cost of the strips 102, 104 (relatively insignificant) and the cost of attaching the strips to the bracket after the bracket is formed (no more than a few cents per device). It is seen that in accordance with the invention, the problems associated with welding a bimetallic laminate material to a shadow mask having a different construction than the contacting bracket metal are obviated, and the cost associated with the use of a laminate-type bimetallic material is eliminated completely.

Whereas the invention set forth in the parent application has been described with respect to a preferred embodiment thereof, many alterations, modifications and variations will be apparent to those skilled in the art in light of the above disclosure. For example, whereas the above-described mask suspension system is believed to most advantageously utilize the teachings of the invention, the invention, because of the substantial cost savings it offers, may be incorporated in conventional tubes of the type having a flanged faceplate, as shown for example in FIG. 8.

The FIG. 8 embodiment discloses the invention of the parent application embodied in a tube having a faceplate which includes a faceplate portion 108 which carries the phosphor screen and a rearwardly extending flange 110. In the FIG. 8 embodiment, a stud 111 is disclosed as having legs 112 embedded in the flange 110, rather than in the faceplate portion 108, as would be suggested by the FIGS. 1–6 embodiment.

In the FIG. 8 embodiment a thermally compensating article constructed in accordance with the invention of the parent application comprises a bracket 113 carrying a pair of strips 114, 116. The strips 114, 116 are composed of a material having a coefficient of thermal expansion significantly different from that of the supporting bracket 113 and may be affixed, as by welding, to the bracket 113. The FIG. 8 embodiment teaches that the strips 114, 116 may, alternatively, be located on the side of the carrying member *closest* to the faceplate portion 108. In this embodiment, the strips 114, 116 will necessarily have a coefficient of thermal expansion which is *greater* than that of the material from which the bracket 113 is composed. Assuming again, as in the FIGS. 1–4 embodiment, that the bracket 113 and the mask 12 are composed of cold-rolled steel, for the reasons given, the strips may, for example, be composed of stainless steel. As in the FIGS. 1–6 embodiment, the bracket preferably extends from the mask such that a normal to the arms thereof has at least a major component parallel to the mask axis, that is, the arms preferably lie in a plane transverse to the mask axis.

Whereas each of the embodiments of the invention of the parent application described above have been shown in connection with corner-mounted shadow masks of one-piece construction, the teachings may be applied to shadow mask assemblies of other types. For example, the invention may be applied in a tube of the conventional type having a flanged front panel and a shadow mask assembly comprising a rigid frame to which is attached a separate perforated shadow mask member. Such assemblies are commonly supported on the rearward flange of the front panel at three (or four) spaced, off-corner points around the mask assembly. An embodiment of the invention of the parent application in such a tube is illustrated in FIGS. 9–11.

Figure 9:
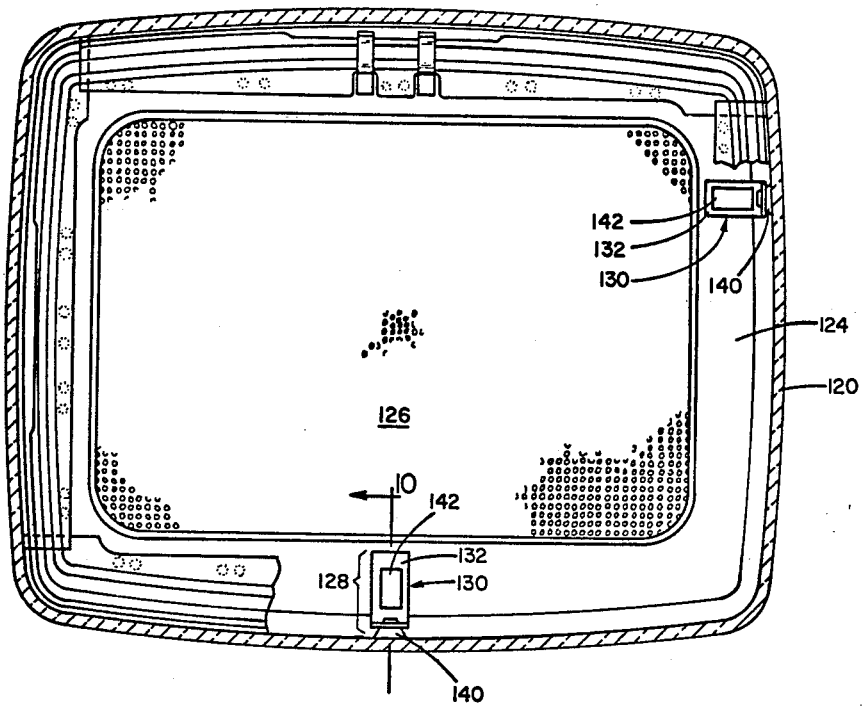
FIGS. 9–11 show other means for suspending a shadow mask assembly in conjunction with a flanged faceplate.
Figure 10:
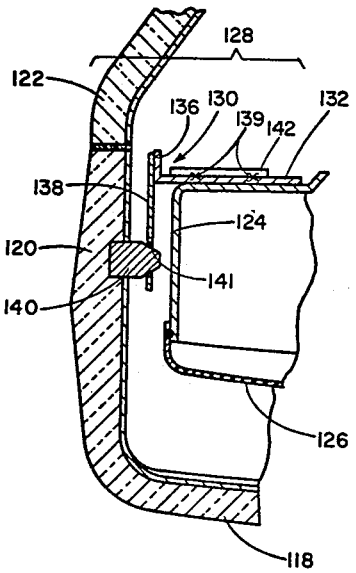
Figure 11:
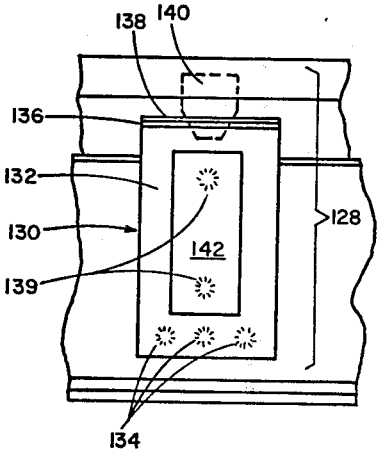

In the FIGS. 9–11 embodiment, a portion of a color CRT tube envelope of the conventional type is shown as including a front panel having a viewing window 118 and a rearwardly extending flange 120. The front panel is mated with a funnel 112. Suspended within the compass of the front panel 120 is a conventional shadow mask assembly of the type having a rigid frame 124 carrying a thin perforate shadow mask member 126. The shadow mask assembly is shown as being suspended at three points around the periphery of the assembly.

The FIGS. 9–11 embodiment has mask suspension devices 128 constructed according to the invention of the parent application. Specifically, and referring to FIG. 9 and particularly to FIGS. 10 and 11, the mask suspension devices 128 include a novel thermally compensating article 130. The article 130 comprises a sheet metal portion, here shown as a substantially rectangular bracket 132, which is affixed at one end to the frame 124, preferably by welding. Illustrative weld points are shown at 134 in FIG. 11.

The bracket 132 has at its distal end a leg 136 (preferably integral) which serves as a base for attachment of a leaf spring 138. The leaf spring 138 may have various constructions, but preferably takes the form shown, for example, at 30 in the FIGS. 1–6 embodiment. The spring 138 is affixed, as by welding, to the bracket 132. Weld points are shown at 139. The spring has provision at its distal end for making retentive but detachable engagement with a provision on the envelope, here shown as a stud 140. The stud 140 is received in an aperture 141 in the spring 138.

In accordance with the invention of the parent application, the use of any laminate bimetallic material is avoided, and yet thermal "Q" compensation is provided by welding onto the bracket 132 at least one strip 142 of material having a significantly different coefficient of expansion than the material from which the bracket 132 is made. In the preferred embodiment, the bracket 132 is composed of the same material as the frame 124, preferably cold-rolled steel, and the strip 142 is composed of material having a significantly lower coefficient of expansion such as invar. As in the above-described embodiment, the desired amount of thermal "Q" compensation can be provided by selecting the appropriate physical parameters of the bracket and strip, by the number of welds, and by appropriate selection of the bracket and strip materials.

The present invention comprises a shadow-mask suspension system for use in a rectangular-type color cathode ray tube having a rearwardly flanged faceplate. The approximately rectangular shadow mask assembly is suspended at a predetermined spacing from the screen-bearing surface of the faceplate. The shadow mask assembly comprises a rigid frame to which is attached a shadow mask member.

In the aforedescribed FIGS. 9–11 embodiment, the bracket 132 is shown as comprising a separate, substantially rectangular piece affixed at one end of the shadow mask frame 124, preferably by welding. According to the preferred embodiment of the present invention, the bracket is formed integrally from the mask assembly, as shown by FIG. 12.

The system for suspending the shadow mask assembly according to the invention comprises a plurality of mask suspension devices spaced around the assembly. Each device comprises a metal stud 140 embedded in the flange 120 of the front panel so as to extend inwardly therefrom, and mask-mounted means for retentively engaging stud 140. The mask-mounted means comprises sheet metal bracket means 132 formed integrally from frame 124 of the mask assembly, according to the invention. The bracket means 132 extends from the assembly in a direction which is such that a normal to the bracket means has at least a major component parallel to the axis of the mask assembly. Each mask suspension device also comprises a discrete metal leaf spring 138 welded at one end at the distal end of bracket means 132 and having provision on its distal end for retentively engaging stud 140. The remainder of the system for suspending the shadow mask assembly according to the invention is the same as hitherto described with regard to the invention of the parent application; that is, the mask-mounted means is characterized by having welded on bracket means 132 at least one flat strip composed of a material having a coefficient of thermal expansion which is significantly different from that of the bracket means 132. Flat strip 142 is arranged on the bracket means 132 and sized such that upon heating of the mask assembly, the bracket means 132 bends out of its plane to effect the compensating adjustment in the spatial position of the mask assembly relative to the faceplate portion.

Whereas the bracket means formed integrally from the mask assembly, and the strip structure depicted in the above-described embodiment are believed to be preferred, numerous modifications and variations may be employed within the spirit and scope of the present invention. Accordingly, I intend to embrace all such alterations, modifications and variations which fall within the spirit and scope of this invention.

What is claimed is:

1. For use in a rectangular color cathode ray tube, of a type having a front panel with a rearward flange which mates with a funnel, a system for suspending an approximately rectangular shadow mask assembly on the rearward flange of the front panel at a predetermined spacing from a screen-bearing faceplate portion of the front panel, said system comprising a plurality of mask suspension devices spaced around the assembly, each comprising:

a metal stud embedded in said flange of said front panel so as to extend inwardly therefrom; and mask-mounted means for retentively engaging said stud, comprising:

sheet metal bracket means formed integrally from said mask assembly and extending radially outward from said assembly in a direction substantially perpendicular to the axis of said assembly, said bracket having at its distal end a leg extending substantially parallel to said axis; and a discrete metal leaf spring welded at one end to said leg of said bracket means and having provision on its distal end for retentively engaging said stud;

said mask-mounted means being characterized by having welded on said bracket means at least one flat strip composed of a material having a coefficient of thermal expansion which is significantly different from that of said bracket means and which is arranged on said bracket means and sized such that upon heating of said mask assembly, said bracket means bends out of its plane to effect a compensating adjustment in the spatial position of the mask assembly relative to the faceplate portion.

2. For use in a rectangular-type color cathode ray tube having a rearwardly flanged faceplate for suspending an approximately rectangular shadow mask assembly on the faceplate flange at a predetermined spacing from a screen-bearing surface of the faceplate, said mask assembly comprising a rigid frame to which is attached a shadow mask member, a plurality of mask suspension devices spaced around the assembly, at least one device comprising:

a metal stud embedded in and extending inwardly from the faceplate flange;

mask-mounted means for retentively engaging said stud, comprising:

sheet metal bracket means formed integrally from said mask assembly so as to extend radially outwardly from the assembly in a direction substantially perpendicular to the axis of said mask assembly, and having at its distal end a leg extending substantially parallel to said axis; and a discrete metal leaf spring affixed at one end to said leg of said bracket means and having provision on its distal end for retentively engaging said stud;

said mask-mounted means being characterized by having welded on said bracket means at least one strip composed of a material having a coefficient of thermal expansion which is significantly different from that of said bracket means and which is arranged on said bracket means and sized such that upon heating of said mask assembly, said bracket means bends out of its plane to effect a compensating adjustment in the spatial position of the mask assembly relative to the screen-bearing surface of the faceplate.

* * * * *